United States Patent [19]

Davis

[11] 4,438,994

[45] Mar. 27, 1984

[54] DRAWERS AND DRAWER RUNNERS

[75] Inventor: Harry H. Davis, Mooresville, N.C.

[73] Assignee: L. B. (Plastics) Limited, Belper, England

[21] Appl. No.: 235,392

[22] Filed: Feb. 18, 1981

[30] Foreign Application Priority Data

Feb. 23, 1980 [GB] United Kingdom ..... 8006181
Oct. 3, 1980 [GB] United Kingdom ..... 8031926

[51] Int. Cl.[3] ..... A47B 88/00; F16C 21/00

[52] U.S. Cl. ..... 312/330 R; 312/338; 312/341 R; 312/348; 308/3.8

[58] Field of Search ..... 312/330 R, 333, 338, 312/341 R, 348; 308/3.8

[56] References Cited

U.S. PATENT DOCUMENTS

| | | | |
|---|---|---|---|
| 2,289,281 | 7/1942 | Zalkind | 312/341 R |
| 2,692,802 | 10/1954 | Kurtzon et al. | 308/3.8 |
| 3,099,501 | 7/1963 | Hillson et al. | 308/3.8 |
| 3,556,626 | 1/1971 | Schock | 312/330 R |
| 3,664,716 | 5/1972 | Johnson | 312/348 |
| 3,973,814 | 8/1976 | Entrikin | 312/330 R |
| 4,090,753 | 5/1978 | Rock et al. | 312/330 R |
| 4,121,878 | 10/1978 | Lokken | 312/341 R |
| 4,190,306 | 2/1980 | Litchfield et al. | 312/330 R |

FOREIGN PATENT DOCUMENTS

| | | | |
|---|---|---|---|
| 678703 | 12/1964 | Italy | 312/341 R |

*Primary Examiner*—Victor N. Sakran
*Attorney, Agent, or Firm*—W. Thad Adams, III

[57] ABSTRACT

A drawer runner comprises a mounting member adapted to be mounted in a cabinet in which a drawer is to be supported in use, a pair of spaced bearing members mounted on the mounting member for engagement in the runner recess in the drawer side, and a fixed load-supporting member carried by the mounting member and adapted to assist in supporting the weight of the drawer when the drawer is laden and in its closed position. The bearing members may comprise rollers rotatably mounted on studs carried by the mounting member, the load-supporting member comprising a flange disposed rearwardly of the rear bearing member or disposed beneath the bearing members and arranged to be contacted by the drawer only when the latter is closed and laden.

14 Claims, 8 Drawing Figures

DRAWERS AND DRAWER RUNNERS

This invention relates to drawers and drawer runners.

There are two principal types of furniture construction in which drawers commonly require to be fitted. One form which will be referred to herein as "framed construction" has side wall panels inter-connected by a front frame having side frame members connected to the side wall panels and cross-pieces inter-connecting the side frame members. In this form of construction the opening in which the drawer is received is spaced from the or each associated side wall panel of the cabinet by a distance equal to the width of the side frame member or members and the side of the drawer is therefore spaced from the side of the cabinet by a similar distance. The second form of construction which will be referred to herein as "panel construction" utilises side wall panels inter-connected at the front of the cabinet by cross-frame members but does not incorporate side frame members so that in this case the side of the drawer runs closely adjacent to the side wall of the cabinet when the drawer is in position.

Drawers are conventionally mounted in cabinets or the like in which they are located in use by means of either fixed runners or roller runner assemblies. Fixed runners have the advantage of simplicity but as the runners are in frictional contact with runner recesses in the drawer sides throughout their lengths there is substantial frictional resistance to sliding movement of the drawer and both the runner and drawer are subjected to wear. It is also difficult with fixed runner systems to produce a smooth runner action. Roller runner assemblies as hitherto proposed have suffered from the disadvantage that they have been of relatively complex construction and generally require components to be mounted both on the drawer and on the cabinet or the like in which it is supported in use. Such assemblies have required the production of complex components and are therefore relatively expensive. In some cases problems also arise in adequately supporting the drawer when heavily loaded and in preventing side-play during opening and closing movement.

It is an object of the present invention to obviate or mitigate at least some of these disadvantages.

The invention provides a drawer runner comprising a mounting member adapted to be mounted in a cabinet in which a drawer is to be supported in use, a pair of spaced bearing members mounted on the mounting member for engagement in a runner recess in the drawer side, and a fixed load-supporting member carried by the mounting member and adapted to assist in supporting the weight of the drawer when the drawer is laden and in its closed position.

The load-supporting member preferably comprises a flange extending at right angles to the mounting member. The load supporting member may be disposed rearwardly of the rear bearing member or may be disposed beneath the bearing members.

In one arrangement the bearing members comprise rollers rotatably mounted on studs carried by said mounting member, said load supporting flange being positioned such that its upper surface is displaced slightly below the upper extremity of the rear roller so as to be contacted by the drawer only when the latter is closed and laden. In an alternative arrangement the load bearing member is disposed beneath the bearing members in a position slightly below that normally adopted by the lower edge of the associated drawer side so as to be contacted by the drawer only when the latter is closed and laden.

Preferably also the bearing members and the load-supporting member are arranged such that the runner may be used at either side of the cabinet.

The mounting member may be adapted for direct mounting on a side wall of the cabinet or the like, in which case it may be relatively short in length. Alternatively the mounting member may be extended rearwardly to enable it to be secured at its ends to front and rear upright frame members of the cabinet. Advantageously the mounting member and the load-supporting member are formed by cutting and pressing from a single metal blank.

The mounting member may be adapted to be secured to and supported solely by a vertical side frame member of a cabinet of framed construction in which the runner is mounted in use, the runner incorporating a bracing member adapted to act between the runner and the side wall of the cabinet at a position displaced rearwardly from the ends of the mounting member which is forwardmost in use.

Preferably the bracing member is of adjustable effective length to enable the position of the runner to be adjusted to take account of tolerances in the cabinet and drawer arising from manufacture. Adjustment may advantageously be effected by utilising a bracing member in the form of a screw engaged in an aperture in the runner and arranged such that its free end abuts against the side wall of the cabinet when the runner is fitted in position.

The mounting member may be formed from a plate incorporating a deformable section which may be bent at right angles to the general plane of the plate whereby to adapt the member for mounting the runner on a cabinet of framed construction. In this way if the mounting plate is not deformed but retained in planar form it may be used to mount the runner on a cabinet of panel construction. Advantageously the runner may be formed as a metal stamping a portion of which may be deformed in a final manufacturing operation to convert the runner from one form to the other.

The runner may advantageously be used in association with a drawer of so called "knock-down" construction incorporating side and rear wall panels of hollow extruded plastics construction inter-connected by corner pieces engaged in the open ends of the wall panels.

The drawer may incorporate retractable stop members disposed at its rear corners and moveable between operative positions in which they project across the runner recesses in the drawer sides and inoperative positions in which they are retracted clear of the runner recesses. In this way the drawer may be engaged with the runners with the stop members in their retracted positions and, following engagement, the stop members may be moved to their operative positions in which they project across the runner recesses and contact the rear roller or other bearing member when the drawer is opened to prevent complete withdrawal of the drawer from the supporting cabinet or like structure.

Embodiment of the invention will now be described, by way of example only, with reference to the accompanying drawings, in which.

Figure 1:
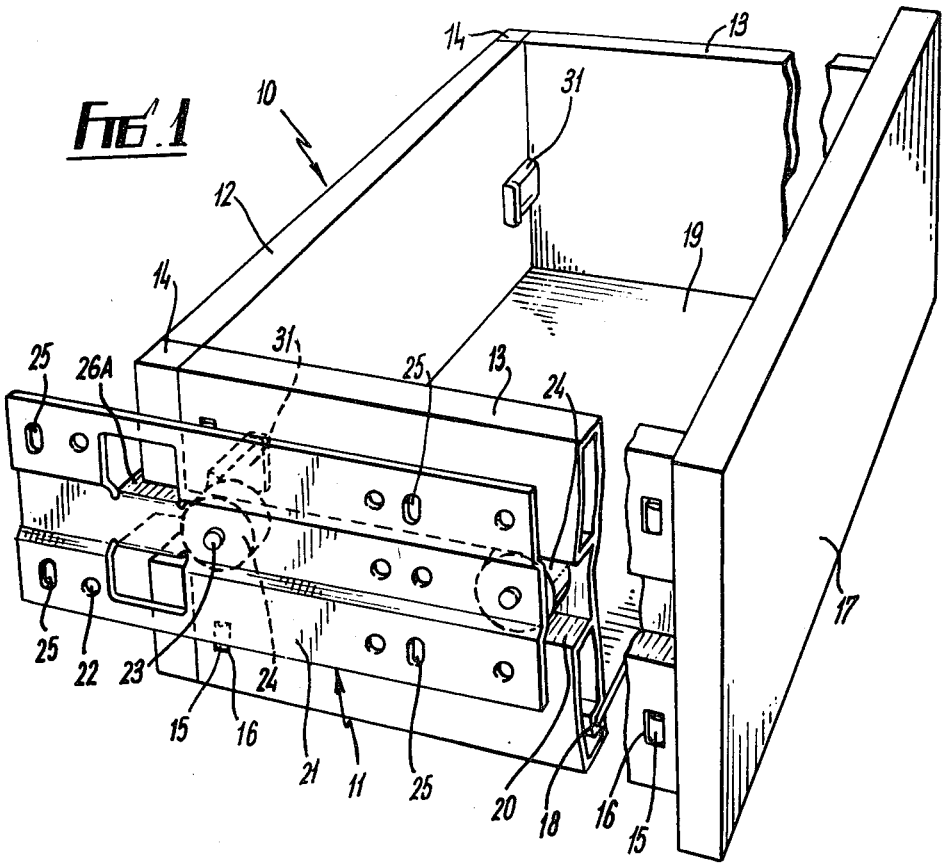
FIG. 1 is a perspective view of a drawer system incorporating one form of runner according to the invention.
Figure 2:
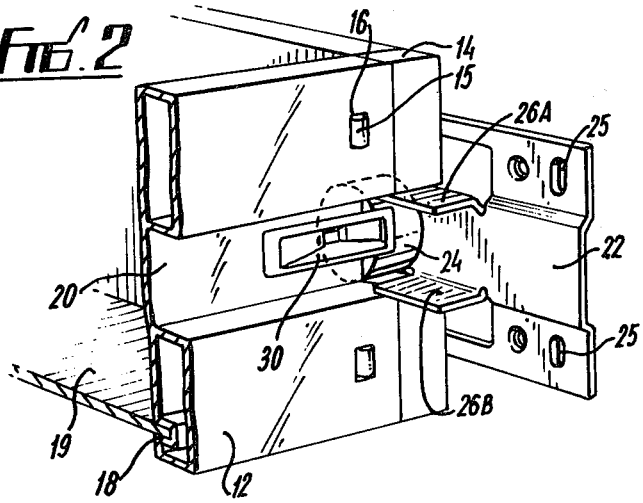
FIG. 2 is a fragmentary perspective view showing one of the rear corners of the drawer system shown in FIG. 1.

Referring to FIGS. 1 and 2, the drawer system comprises a drawer 10 mounted at each side on a runner 11 adapted to be supported in a cabinet or other supporting structure (not shown) in which the drawer is slideably mounted in use. The drawer is of knock-down construction comprising a back wall 12 and side walls 13 of extruded plastic construction inter-connected at the rear of the drawer by corner pieces 14. These corner pieces are provided with projecting spigots (not shown) which engage in the open ends of the wall panels 12, 13 and have upstanding detents 15 which engage in apertures 16 formed adjacent the ends of the wall panels. At the front of the drawer a facia panel 17 is connected to the front ends of the side wall panels 13 by connecting pieces (not shown) which have spigots engaging in the open ends of the wall panels 13 and retained by detents 15 on the spigots locating in apertures 16 in the wall panels in a manner similar to that at the rear of the drawer. The wall panels 12, 13 and the facia panel 17 are provided with inwardly opening slots 18 which receive edges of a base board or drawer bottom 19. The side and rear wall panels 12, 13 are formed by cutting suitable lengths from a common extrusion and are provided with longitudinally extending outwardly opening recesses or tracks 20. The recesses 20 in the side wall panel 13 are adapted for engagement with the drawer runners 11 to slidably support the drawer in its cabinet or like supporting structure.

A runner 11 is provided at each side of the drawer but only one such runner is shown in the drawings for purposes of simplicity. The runner comprises a mounting member in the form of a plate 21 formed with a central longitudinally extending channel 22 which serves to rigidify the plate and incorporates apertures to receive pins 23 on which front and rear rollers 24 are freely rotatably mounted. The mounting plate is provided with apertures 25 enabling it to be screwed or otherwise secured directly to the side wall of the cabinet.

The portion of the mounting plate 21 rearwardly of the rear roller 24 incorporates a pair of flanges 26A, 26B which are formed integrally with the plate and are bent at right angles to it. In the position shown in FIG. 1 of the drawings the flange 26A constitutes the upper flange and is positioned slightly below the level of the upper surfaces of the rollers 24. During normal opening and closing movements the drawer does not contact the flange 26A, but when the drawer is closed it tends to drop slightly into contact with the flange 26A which thus assists in supporting the weight of the drawer, especially when heavily loaded. The flange 26B does not serve any function when the runner is in the position shown in FIG. 1, but the construction of the runner is such that by inverting it it may be used at the opposite side of the drawer and the flange 26B then becomes the upper flange and acts in the same manner as the flange 26A in the drawings.

A retractable stop member 30 is provided at each rear corner of the drawer and is slideably mounted on the rear wall panel 13 at the level of the recesses 20. The stop member 30 is moveable, by means of a finger piece 31 disposed within the drawer, between a retracted position in which it is clear of the runner recess 20 in the associated drawer side and an operative position in which it projects across the runner recess and engages with the rear roller 24 when the drawer is fully opened. In this way complete withdrawal of the drawer from the cabinet during normal opening and closing movements is prevented.

Thus in use of the assembly the drawer runners are mounted on the side walls of a cabinet or the like in which the drawer is to be supported in use and extend horizontally rearwardly from the front of the cabinet. The drawer may then be inserted into the cabinet by engaging the tracks 20 in the side walls with the rollers 24. When the rear of the drawer has been moved into the cabinet beyond the rear roller 24 the finger pieces 31 are manipulated to move the stop members 30 to their operative positions. During normal opening and closing movement of the drawer it is supported wholly by the rollers 24 and engagement of the stop members 30 with the rear rollers 24 prevents complete withdrawal of the drawer from the cabinet. When the drawer is closed, and especially if it is heavily loaded, its rear end drops and is supported on the load bearing flanges 26A. If it is desired subsequently to remove the drawer from the cabinet the finger pieces 31 are manipulated to move the stop members to their inoperative retracted positions and the drawer may then be drawn clear of the runners.

Figure 3:
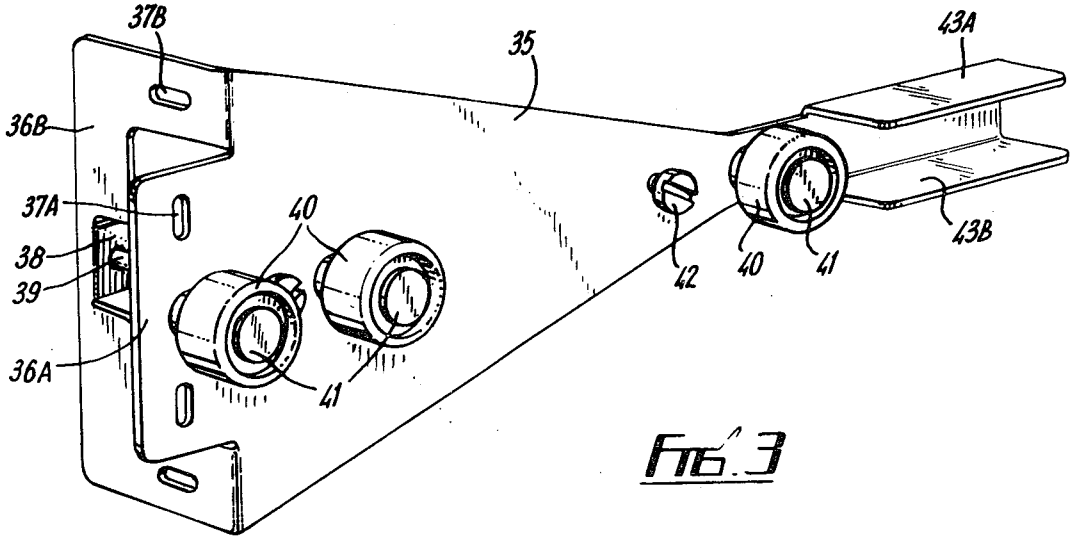
FIG. 3 is a perspective view of an alternative form of drawer runner according to the invention.
Figure 4:
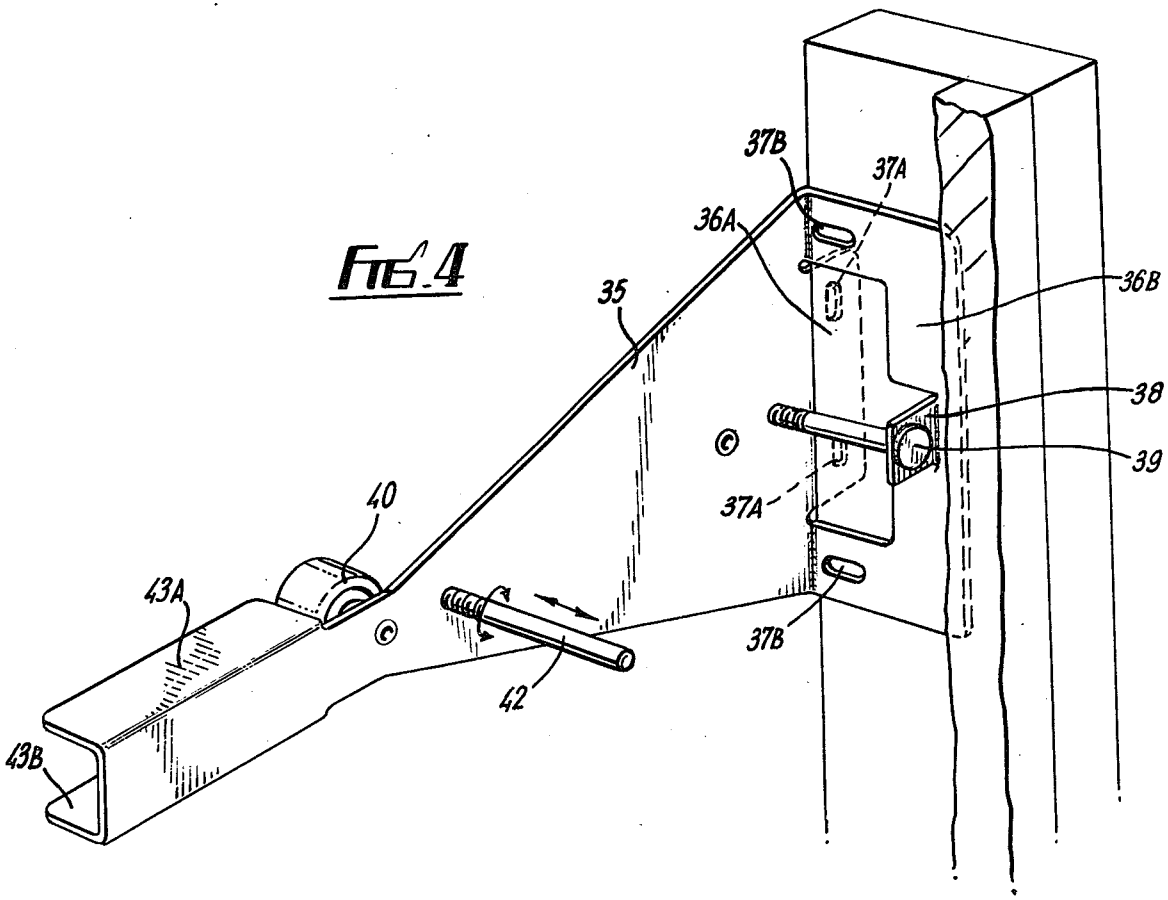
FIG. 4 is a perspective view showing the runner of FIG. 3 mounted on a cabinet and viewed from the opposite side.

Referring now to FIGS. 3 and 4 there is shown an alternative form of runner comprising a mounting plate 35 which is preferably formed as a metal stamping and is of tapered construction being of greater height at the end which is forward most in use. At the forward end a U-shaped cut is formed in the plate enabling a portion of the plate to be bent at right angles to the remainder whereby forming a mounting bracket having arms 36A and 36B extending at right angles to one another. In this way the runner may be mounted on a vertical side frame member of a cabinet of framed construction so as to be supported solely on the side frame member. Vertically elongated slots 37A are formed in the arm 36A and horizontally elongated slots 37B are formed in the arm 36B to enable the position of the runner to be adjusted both horizontally and vertically. A tab 38 is bent from the arm 36B into a plane parallel to the main body of the mounting plate 35 and a screw 39 extends between the tab 38 and the plate 35 to act as a bracing member.

A pair of bearing members in the form of rollers 40 are freely rotatably mounted on shafts 41 mounted on plate 35 towards the forward end thereof, and a similar roller 40 is mounted on a shaft 41 towards the rear of the plate 35. These rollers are adapted to engage in the runner recess of a drawer in order to support and guide the drawer on the runner. A bracing member in the form of a screw 42 extends through the plate 35 in a position forwardly of the rear roller 40 and extends between the plate 35 and the side wall of the cabinet to brace the plate 35 against flexing movement. The screw 42 may also be adjusted to alter the position of the plate 35 in a direction laterally of the drawer. This serves to take up tolerance between the drawer and the runner and prevent undue side movement which can result in a sloppy action when the drawer is opened and closed.

The portion of the plate 35 rearwardly of the rear roller 40 incorporates a pair of flanges 43A, 43B which are formed integrally with the plate 35 and are bent at right angles to it. In the position shown in FIG. 3 the plate 43A constitutes the upper plate and is positioned slightly below the level of the upper surfaces of the rollers 40. During normal sliding movement of the drawer it does not contact the plate 43A but when the drawer is closed it tends to drop slightly into contact with the plate 43A which thus assists in supporting the weight of the drawer especially when heavily loaded. The plate 43B does not serve any function when the runner is in the position shown in FIG. 3 but when the runner is fitted to the opposite side of a cabinet it is inverted relative to the position shown in FIG. 3 and the flange 43B then becomes the upper flange and acts in the same manner as the flange 43A shown in FIG. 3.

Thus in use of the runner it is mounted by means of the bracket 36A, 36B on the vertical side frame member of a cabinet of framed construction and extends rearwardly from the front frame of the cabinet in a position alongside the side wall. The stud 42 acts between the plate 35 and the side wall of the cabinet to brace the runner against flexing movement and a drawer may then be inserted into the cabinet for rolling engagement with the rollers 40. During normal opening and closing movements of the drawer it is supported wholly by the rollers 40 but when the drawer is closed, and especially if it is heavily loaded, its rear end drops and is supported on the flange 43A.

A further advantage of the arrangement described resides in the fact that prior to forming of the front mounting bracket, the arm 36B lies in the same plane as the arm 36A and if it is not bent out of this plane the runner is generally planar in form and may be mounted on the side wall of a cabinet of panel construction. Thus the same runner may be used in association with cabinets of either panel or frame construction by the simple expedient of modifying the front end of the runner by bending the arm 36B or leaving it unbent as required. In this way the same tooling may be utilised to provide a universal form of runner adapted for use with cabinets of either type of construction.

Figure 5:
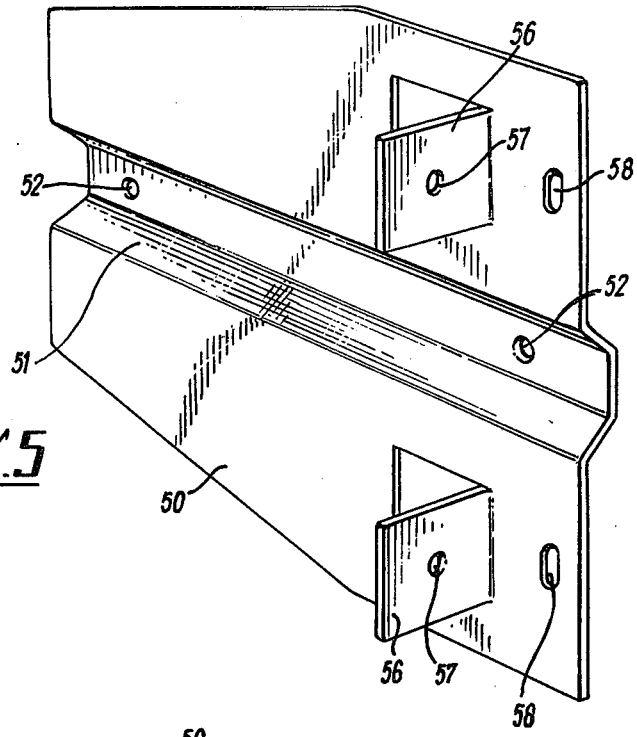
FIG. 5 is a perspective view of an alternative form of runner viewed from one side.
Figure 6:
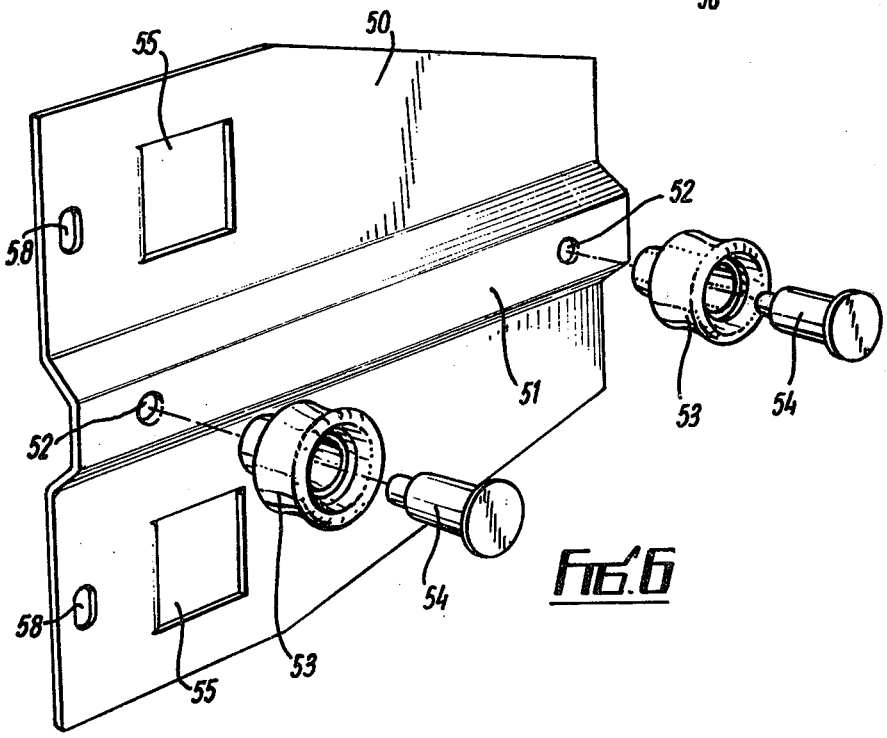
FIG. 6 is a perspective view of the runner shown in FIG. 5 viewed from the other side and with certain parts detached for purposes of illustration.

Referring now to FIGS. 5 and 6, the runner incorporates a mounting plate 50 formed with a central longitudinally extending channel 51 which serves to rigidify the plate and also incorporates mounting holes 52 for front and rear rollers 53 freely rotatably mounted on pins 54. Upper and lower openings 55 are formed towards the front edge of the plate 50 by cutting and bending out of the plane of the plate two flanges or tabs 56 which are disposed at right angles to the plate and form, together with the leading edge of the plate, a bracket for mounting the runner on the vertical side frame member of a cabinet of framed construction. The tabs 56 each incorporate an aperture 57 which, together with elongated apertures 58 formed adjacent the forward edge of the plate 50 enable the runner to be vertically adjustably mounted in the cabinet frame.

It will be appreciated that the form of runner shown in FIGS. 5 and 6 is adapted to be supported solely from the vertical side frame member of a cabinet of frame construction but may also be fitted to the side wall of a cabinet of panel construction by arranging for the tabs 56 to remain in the plane of the plate 50 instead of being bent at right angles to the plate. In this way the runner may be fitted to cabinets of panel or framed construction by a simple modification of the manufacturing process. The runner may also be inverted and used at either side of the cabinet without modification. Although not illustrated the form of runner shown in FIGS. 5 and 6 is preferably provided with a rear load-supporting member similar to that shown in FIGS. 1 and 2.

Figure 7:
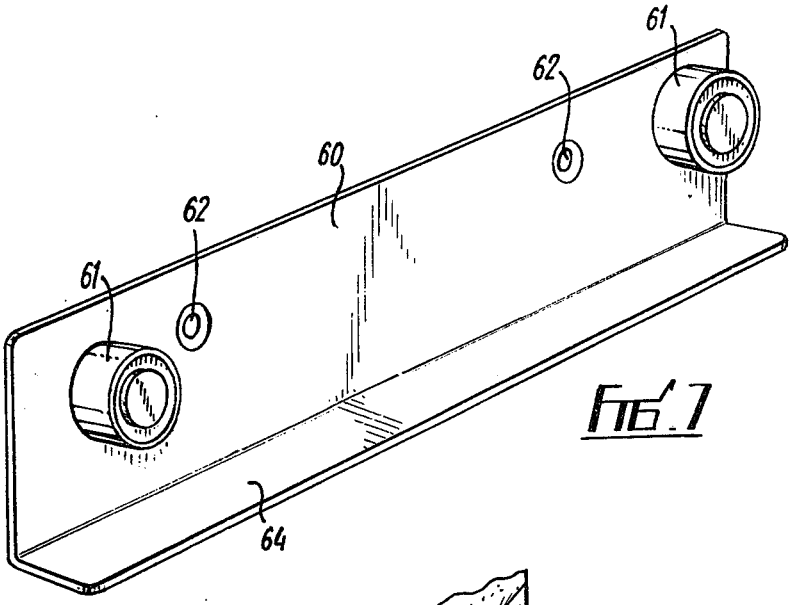
FIG. 7 is a perspective view of a further form of runner according to the invention.
Figure 8:
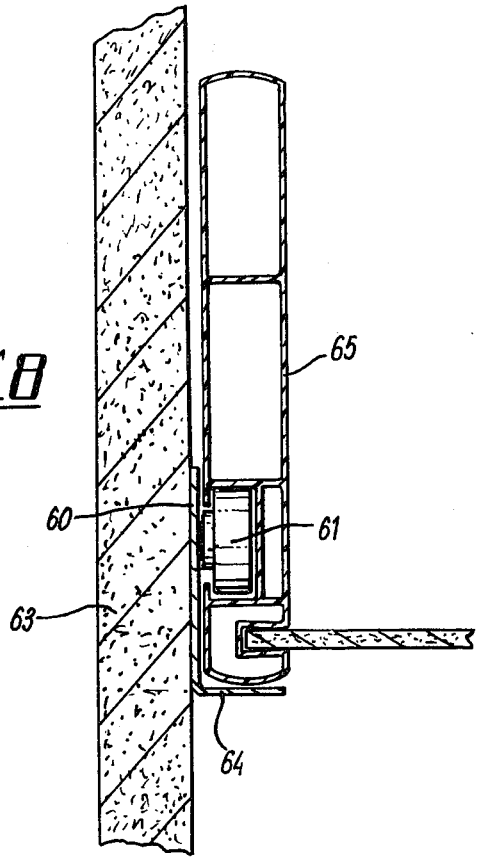
FIG. 8 is fragmentary vertical cross-section through a drawer system incorporating the runner shown in FIG. 7.

FIGS. 7 and 8 show a further modification comprising a mounting member in the form of a bracket of generally L-shape in cross-section, the main upright portion 60 of which rotatably supports spaced front and rear bearing members in the form of rollers 61 and is provided with apertures 62 enabling it to be secured in position on a wall 63 (FIG. 8) of a cabinet in which the drawer is to be mounted in use. The lower portion of the bracket comprises a flange 64 which extends for the full length of the bracket and projects beneath the side wall 65 of the drawer (FIG. 8). The flange 64 is displaced beneath the rollers 61 by a distance such that during normal opening and closing movement of the drawer the lower surface of the side wall 65 is clear of flange but when the drawer is closed, and especially if it is heavily loaded, its rear end drops and the load is partly supported by the flange 64.

The form of runner shown in FIGS. 7 and 8 is formed from a single metal blank and is especially adapted for use in association with drawers of different depth but having side walls in which the distance of the runner recess in which the rollers 61 engage is the same for all the sizes.

It will be appreciated that since the runners are of extremely simple design the benefits of roller runner mounting are secured without requiring complex roller assemblies and without requiring any modification to the drawer itself. The system is therefore of simple and cheap construction yet provides the advantages of roller mounting and can be used in association with any drawers of conventional construction provided with runner recesses in their side walls.

Various modifications may be made without departing from the invention. For example any desired number of rollers may be provided on the runners and any one or more of the rollers may be replaced by fixed skids or other bearing members. Although particularly suited to manufacture as metal stamping the runners could also be formed of plastics material. The retractable stop members on the drawer may be omitted or replaced by alternative means of preventing complete withdrawal of the drawer from its cabinet during use. In a further modification the runners may be extended rearwardly and secured at their forward and rear ends to upright frame members instead of being mounted directly on the side walls of the cabinet. In this way the runners may be fitted to most forms of furniture cabinet in current use without substantial modification.

I claim:

1. A drawer runner comprising a mounting member adapted to be mounted in a cabinet in which a drawer is to be supported in use, a pair of spaced bearing members in the form of rollers rotatably mounted on studs carried by said mounting member for engagement in a runner recess in the drawer side, and a fixed load-supporting flange mounted on and extending at right angles to said mounting member in a position rearwardly of said bearing member, said flange being adapted to assist by contacting the runner recess of said drawer in supporting the weight of the drawer when the drawer is laden and in its closed position.

2. A drawer runner according to claim 1, wherein said bearing members and said load-supporting member are arranged such that the runner may be used at either side of the cabinet.

3. A drawer runner according to claim 1, wherein said mounting member comprises a plate incorporating a deformable section which may be bent at right angles to the general plane of the plate whereby to adapt the member for mounting the runner on a side wall or a frame member of a cabinet or the like.

4. A drawer runner according to claim 1, wherein said mounting member and said load-supporting member are formed by cutting and pressing from a single metal blank.

5. A drawer runner according to claim 1, wherein said mounting member is adpated for direct mounting on a side wall of a cabinet or the like.

6. A drawer runner according to claim 1, wherein said mounting member is adapted to be secured at its ends to front and rear upright frame members of a cabinet or the like.

7. A drawer assembly comprising a pair of drawer runners according to claim 1 and a drawer having runner recesses formed in the sides thereof, wherein the drawer is of knock-down construction incorporating side and rear wall panels of hollow extruded plastics construction inter-connected by corner pieces engaged in the open ends of the wall panels.

8. A drawer assembly comprising a pair of drawer runners according to claim 1, wherein the drawer incorporates retractable stop members disposed at its rear corners and moveable between operative positions in which they project across runner recesses in the drawer sides and inoperative positions in which they are retracted clear of the runner recesses.

9. A drawer runner according to claim 1 wherein said mounting member is adapted to be secured to and supported solely by a vertical side frame member of a cabinet.

10. A drawer runner according to claim 1 incorporating a bracing member adapted to act between the runner and the side wall of the cabinet at a position displaced rearwardly from the ends of the mounting member which is forwardmost in use.

11. A drawer runner comprising a mounting member adapted to be mounted in a cabinet in which a drawer is to be supported in use, a pair of spaced bearing members mounted on the mounting member for engagement in a runner recess in the drawer side, and a fixed load-supporting flange mounted on and extending at right angles to said mounting member and disposed beneath said bearing members in a position slightly below that normally adopted by the lower edge of the associated drawer side, whereby said flange is contacted by and assists in supporting the weight of the drawer only when the latter is laden and in its closed position.

12. A drawer runner according to claim 11, wherein said bearing members and said load-supporting member are arranged such that the runner may be used at either side of the cabinet.

13. A drawer runner according to claim 11 wherein said mounting member is adapted to be secured to and supported solely by a vertical side frame member of a cabinet.

14. A drawer runner according to claim 9 or 13 incorporating a bracing member of adjustable effective length adapted to act between the runner and the side wall of the cabinet at a position displaced rearwardly from the end of the mounting member which is forwardmost in use.

* * * * *